US009803333B2

(12) United States Patent
Horii

(10) Patent No.: US 9,803,333 B2
(45) Date of Patent: Oct. 31, 2017

(54) HYDRAULIC SYSTEM FOR WORKING MACHINE

(71) Applicant: KUBOTA CORPORATION, Osaka (JP)

(72) Inventor: Hiroshi Horii, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 404 days.

(21) Appl. No.: 14/661,285

(22) Filed: Mar. 18, 2015

(65) Prior Publication Data

US 2015/0275468 A1 Oct. 1, 2015

(30) Foreign Application Priority Data

Mar. 28, 2014 (JP) ..... 2014-068716

(51) Int. Cl.
*F15B 11/02* (2006.01)
*E02F 3/42* (2006.01)
(Continued)

(52) U.S. Cl.
CPC ..... *E02F 3/425* (2013.01); *E02F 9/226* (2013.01); *E02F 9/2235* (2013.01);
(Continued)

(58) Field of Classification Search
CPC ..... E02F 9/2296; F15B 21/042
(Continued)

(56) References Cited

U.S. PATENT DOCUMENTS 4,945,723 A * 8/1990 Izumi ..... E02F 9/2225 137/596.14
7,571,558 B2 * 8/2009 Horii ..... E02F 9/2239 37/348
(Continued)

FOREIGN PATENT DOCUMENTS

CN 101158167 4/2008
JP 03-221627 9/1991
(Continued)

OTHER PUBLICATIONS

Chinese Office Action issued in Counterpart Patent Appl. No. 201510116537.9, dated Dec. 14, 2016.
Japanese Office Action issued in Counterpart Patent Appl. No. 2014-068716, dated Jul. 4, 2017.

*Primary Examiner* — Thomas E Lazo
(74) *Attorney, Agent, or Firm* — Greenblum & Bernstein, P.L.C.

(57) ABSTRACT

A hydraulic system includes: hydraulic actuators; a control valve for controlling the hydraulic actuators; a tank for storing a hydraulic operation fluid; a variable displacement pump for supplying the hydraulic operation fluid to the hydraulic actuators; a regulator for controlling the variable displacement pump; a pilot pump for discharging a hydraulic pilot fluid; a load sensing system for maintaining a differential pressure to be a constant pressure, the differential pressure being obtained by subtracting a second signal pressure from a first signal pressure that is the discharge pressure of the variable displacement pump, the second signal pressure being the maximum one of the load pressures generated in the hydraulic actuators; a signal tube for sending the second signal pressure to the regulator; a throttle provided on the signal tube; and a warm-up circuit for supplying the hydraulic pilot fluid to a downstream side of the throttle.

10 Claims, 7 Drawing Sheets

(51) Int. Cl.
*F15B 11/028* (2006.01)
*E02F 9/22* (2006.01)
*F15B 21/04* (2006.01)

(52) U.S. Cl.
CPC ..... *E02F 9/2285* (2013.01); *E02F 9/2292* (2013.01); *E02F 9/2296* (2013.01); *F15B 11/028* (2013.01); *F15B 21/042* (2013.01); *F15B 2211/20538* (2013.01); *F15B 2211/20553* (2013.01); *F15B 2211/20576* (2013.01); *F15B 2211/212* (2013.01); *F15B 2211/25* (2013.01); *F15B 2211/30555* (2013.01); *F15B 2211/50572* (2013.01); *F15B 2211/528* (2013.01); *F15B 2211/605* (2013.01); *F15B 2211/6057* (2013.01); *F15B 2211/611* (2013.01); *F15B 2211/62* (2013.01); *F15B 2211/633* (2013.01); *F15B 2211/635* (2013.01); *F15B 2211/6343* (2013.01); *F15B 2211/6355* (2013.01)

(58) Field of Classification Search
USPC ..... 60/329
See application file for complete search history.

(56) References Cited

U.S. PATENT DOCUMENTS

| | | | | |
|---|---|---|---|---|
| 7,743,611 | B2 * | 6/2010 | Horii | E02F 9/2239 60/421 |
| 7,818,968 | B2 * | 10/2010 | Umezu | F15B 11/055 60/468 |
| 8,701,399 | B2 * | 4/2014 | Horii | E02F 9/2239 60/421 |
| 9,377,034 | B2 * | 6/2016 | Horii | F15B 7/003 |
| 2014/0208734 | A1 | 7/2014 | Horii | |

FOREIGN PATENT DOCUMENTS

| | | | | |
|---|---|---|---|---|
| JP | 04-285304 | | 10/1992 | |
| JP | 05-79062 | | 3/1993 | |
| JP | 05-202911 | | 8/1993 | |
| JP | 2572936 | | 3/1998 | |
| JP | 2008-267490 | | 11/2008 | |
| JP | WO 2013190726 | A1 * | 12/2013 | F15B 7/003 |
| JP | 2014-001563 | | 1/2014 | |

* cited by examiner

HYDRAULIC SYSTEM FOR WORKING MACHINE

CROSS-REFERENCE TO RELATED APPLICATIONS

The present application claims priority under 35 U.S.C. §119 to Japanese Patent Application No. 2014-068716, filed Mar. 28, 2014. The contents of this application are incorporated herein by reference in their entirety.

BACKGROUND OF THE INVENTION

Field of the Invention

The present invention relates to a hydraulic system for a working machine such as a backhoe, the hydraulic system including a load sensing system.

Description of the Related Art

Japanese Unexamined Patent Application Publication No. 2014-1563 (Patent Document 1) and Japanese Examined Utility Model Registration Publication No. 2572936 (Patent Document 2) each disclose a hydraulic system for working machines as the hydraulic system for a working machine, the hydraulic system including a load sensing system.

The hydraulic system for working machines disclosed in Japanese Unexamined Patent Application Publication No. 2014-1563 (Patent Document 1) includes: a plurality of hydraulic actuators; a control valve; a variable displacement pump; a regulator; and a pilot pump. The control valve is configured to control the hydraulic actuators. The variable displacement pump is configured to supply a hydraulic operation fluid (a hydraulic operation oil) to the hydraulic actuators. The regulator is configured to control the variable displacement pump. The pilot pump is configured to discharge a hydraulic pilot fluid (a hydraulic pilot oil). The hydraulic system for working machines further includes a load sensing system. The load sensing system is configured to control a discharge pressure from the variable displacement pump with the regulator, thereby obtaining a constant differential pressure between a PPS (Pressure of Pump Sensing) signal pressure and a PLS (Pressure of Load sensing) signal pressure. The differential pressure is a subtraction between the PLS signal pressure and the PPS signal pressure, the PLS signal pressure being the maximum load pressure of load pressures in the hydraulic actuators, the PPS signal pressure being the discharge pressure from the variable displacement pump.

In addition, the hydraulic system is provided with a PLS signal tube for transferring the PLS signal pressure to the regulator. The PLS signal tube is disposed between the control valve and the regulator, extending from the control valve to the regulator. Moreover, the hydraulic system is provided with a throttle in the middle of the PLS signal tube for a stable operation.

The hydraulic system for working machines disclosed in Japanese Examined Utility Model Registration Publication No. 2572936 (Patent Document 2) includes a load sensing system constituted of: a variable displacement pump; a hydraulic actuator; an operation valve; a displacement control cylinder; a pilot cylinder; and a load sensing valve. The hydraulic actuator is driven by the variable displacement pump. The operation valve is provided on a tube disposed between the variable displacement pump and the hydraulic actuator. The displacement control cylinder controls a displacement of the variable displacement pump. The pilot cylinder has a spring at one end of the pilot cylinder, the spring being for setting a differential pressure. The pilot cylinder is moved to a position for supplying a control pressure to the displacement control cylinder to be connected to a portion on an upstream side of the operation valve, and the pilot cylinder is moved to a position for discharging the control pressure of the displacement control cylinder to be connected to a portion on a lower stream side of the operation valve. The hydraulic system is provided with a tube for connecting both of the pilot cylinders of the load sensing valve to each other, the tube including a switch valve for switching a state of the tube to an opened state and to a closed state.

The hydraulic system sets the switch valve to the opened state when a fluid temperature (an oil temperature) is low, the switch valve being configured to open and close the tube for connecting both of the pilot cylinders of the load sensing valve to each other. Then, the differential pressure between both of the pilot cylinders of the load sensing valve disappears, and thereby the load sensing valve is moved, by the spring for setting the differential pressure, to the position for discharging the control pressure of the displacement control cylinder. Accordingly, the hydraulic system controls the displacement of the variable displacement pump to be maximized to increase an amount of the hydraulic operation fluid relieved from a safety valve, the hydraulic operation fluid being of the hydraulic operation fluid discharged from the hydraulic pump, and thereby a loss of the pressure of the relieved hydraulic operation fluid rapidly increases the temperature of the hydraulic operation fluid.

SUMMARY OF THE INVENTION

Problems to be Solved by the Invention

In order to achieve the stable operation, the hydraulic system disclosed in Japanese Unexamined Patent Application Publication No. 2014-1563 transfers the PLS signal pressure to the regulator through the throttle. In a cold district, the temperature of the hydraulic operation fluid becomes low, and thus the cold, low-temperature, hydraulic operation fluid has a high viscosity resistance. Accordingly, in the hydraulic system, the throttle produces a resistance to the cold hydraulic operation fluid, thereby causing a response lag as a problem.

Additionally, the working machine is sufficiently warmed up generally in a cold district, and thereby the hydraulic operation fluid in the main circuit is warmed. However, a circuit for the PLS signal pressure is not warmed even in the sufficient warming-up, the circuit for the PLS signal pressure is warmed in a work actually performed after the warming-up. Thus, the sufficient warming-up does not necessarily eliminate the response lag caused at the begging of the work actually performed.

In addition, although the hydraulic system disclosed in Japanese Examined Utility Model Registration Publication No. 2572936 rapidly warms up the working machine, the hydraulic system warmed too much has a problem that requests frequent repetition of switching of the switch valve.

In particular, the variable displacement pump discharges the maximum flow of the hydraulic operation fluid during the warming-up. However, in the load sensing system, the variable displacement pump discharges only a requested flow of the hydraulic operation fluid when the work actually performed starts, thus the variable displacement pump reduces the flow of the hydraulic operation fluid when the work actually performed starts, and thereby the temperature of the hydraulic operation fluid decreases. Specifically, since the PLS signal pressure is affected by an outdoor temperature, an operator of the working machine feels deterioration of the response when the temperatures of the hydraulic operation fluid and of the PLS signal pressure decrease after the starting of the work actually performed, thus being requested to frequently perform the warming-up in a pause of the work actually performed. In addition, a hydraulic actuator driven immediately after or in the warming-up, the hydraulic actuator starts moving from a state where a swash plate of the variable displacement pump is at the maximum angle, thereby suddenly starting moving, the sudden moving is an undesirable problem. In order to prevent the undesirable problem, the operator needs to stop the warming-up early before driving the hydraulic actuator.

As described above, the hydraulic system disclosed in Japanese Examined Utility Model Registration Publication No. 2572936 requests frequent repetition of switching of the switch valve in a pause of the work actually performed. The frequent repetition of switching of the switch valve changes the engine sound, for example, and thereby the operator of the working machine feels uncomfortable.

In addition, the hydraulic system disclosed in Japanese Examined Utility Model Registration Publication No. 2572936 considers only warming up the main circuit and does not consider warming up the PLS signal tube and the throttle for PLS, the PLS signal tube being disposed from the control valve for controlling the hydraulic actuator to the regulator for controlling the variable displacement pump. Thus, the deteriorating response in the driven hydraulic actuator cannot be eliminated when the temperatures of the PLS signal tube and of the throttle for PLS are low.

Accordingly, considering the above-mentioned problems, the present invention intends to provide a hydraulic system for a working machine, the hydraulic system being capable of eliminating the response lag of the load sensing system in the low temperature and being capable of stably maintaining an effect of the warming-up.

Means of Solving the Problems

To solve the above-mentioned technical problems, techniques that the present invention provides are characterized in the following points.

In a first aspect of the present invention, a hydraulic system for a working machine, includes: a plurality of hydraulic actuators; a control valve configured to control the hydraulic actuators; a tank configured to store a hydraulic operation fluid; a variable displacement pump configured to discharge the hydraulic operation fluid stored in the tank to supply the hydraulic operation fluid to the hydraulic actuators; a regulator configured to control the variable displacement pump; a pilot pump configured to discharge a hydraulic pilot fluid; a load sensing system configured to control a discharge pressure of the variable displacement pump with use of the regulator to maintain a differential pressure to be a constant pressure, the differential pressure being obtained by subtracting a second signal pressure from a first signal pressure that is the discharge pressure of the variable displacement pump, the second signal pressure being the maximum one of the load pressures generated in the hydraulic actuators; a signal tube provided extending from the control valve to the regulator, the signal tube being configured to send the second signal pressure to the regulator; a throttle provided on the signal tube; and a warm-up circuit configured to supply the hydraulic pilot fluid to a downstream side of the throttle provided on the signal tube.

In a second aspect of the present invention, the hydraulic system for a working machine according to the first aspect of the present invention, further includes: a discharge circuit configured to make the hydraulic operation fluid flow. The warm-up circuit includes: a connection fluid tube configured to connect the discharge circuit and the signal tube to each other; and a check valve configured to prevent a backward flow from the signal tube toward a side of the discharge circuit.

In a third aspect of the present invention, the hydraulic system for a working machine according to the first aspect of the present invention, further includes: a discharge circuit configured to make the hydraulic operation fluid flow. The warm-up circuit includes: a connection fluid tube configured to connect the discharge circuit and the signal tube to each other; and a warm-up switch valve configured to be freely switchable between a communicating position and a blocking position, the communicating position being for making the connection fluid tube be communicated, the blocking position being for making the connection fluid tube be blocked.

In a fourth aspect of the present invention, in the hydraulic system for a working machine according to the second aspect of the present invention, the warm-up circuit includes: a warm-up switch valve configured to be freely switchable between a communicating position and a blocking position, the communicating position being for making the connection fluid tube be communicated, the blocking position being for making the connection fluid tube be blocked.

In a fifth aspect of the present invention, the hydraulic system for a working machine according to the third aspect or the fourth aspect of the present invention, further includes: a control unit configured to control the warm-up switch valve; and a fluid temperature detection sensor configured to detect a temperature of the hydraulic operation fluid. The control unit switches the warm-up switch valve to the communicating position when the fluid temperature detection sensor detects a temperature equal to or less than a first temperature and switches the warm-up switch valve to the blocking position when the fluid temperature detection sensor detects a temperature equal to or more than a second temperature higher than a first temperature.

In a sixth aspect of the present invention, the hydraulic system for a working machine according to any one of the third aspect to the fifth aspect of the present invention, further includes: a control unit configured to control the warm-up switch valve; an engine; and an engine speed sensor configured to detect a revolution speed of the engine. The control unit switches the warm-up switch valve to the blocking position when the engine speed sensor detects a revolution speed equal to or higher than a predetermined revolution speed.

In a seventh aspect of the present invention, the hydraulic system for a working machine according to any one of the third aspect to the sixth aspect of the present invention, further includes: a control unit configured to control the warm-up switch valve; and a lock lever configured to be set from a first position to a second position, the second position being for disabling operations of the hydraulic actuators. The control unit switches the warm-up switch valve to the communicating position when the lock lever is set to the second position.

Effects of the Invention

According to the present invention, the following effects are provided.

In the first aspect of the present invention, the signal tube and the throttle are warmed up by supplying the hydraulic pilot fluid, the hydraulic pilot fluid being discharged from the pilot pump, to a downstream side of the throttle of the signal tube in the warming-up, thereby eliminating the response lag of the load sensing system in the low temperature.

In addition, the pilot pressure is transmitted to the signal tube, and thereby the pilot pressure is added to the second signal pressure. In this manner, the variable displacement pump is controlled to increase the flow amount discharged from the variable displacement pump. The increasing of the flow amount promotes increasing of a temperature of the hydraulic operation fluid, thereby shortening a time for the warming-up.

In addition, since the pilot pressure discharged from the pilot pump is at a constant low pressure, the swash plate of the variable displacement pump is balanced at a certain plate angle between the minimum plate angle and the maximum plate angle when the pilot pressure is transmitted to the signal tube. Accordingly, the hydraulic system according to the present invention is capable of maintaining an effect of the warming-up stably for a long time without excessively increasing the temperature of the hydraulic operation fluid, the excessively increasing being caused by excessively increasing a speed of the warming-up by keeping the swash plate of the variable displacement pump at the maximum plate angle as in the hydraulic system disclosed in the conventional technique (Japanese Examined Utility Model Registration Publication No. 2572936).

Moreover, in the second aspect of the present invention, the check valve is disposed on the connection fluid tube for connecting the signal tube and the discharge circuit for the pilot pump to each other, the check valve is configured to prevent the backward flow of the hydraulic operation fluid, the backward flow running from the signal tube toward a side of the discharge circuit for the pilot pump. In this manner, the hydraulic system is capable of preventing a high-pressured pilot fluid from flowing in a backward direction from the signal tube to a side of the discharge circuit for the pilot pump.

Furthermore, in the third aspect and the fourth aspect of the present invention, the warm-up switch valve is disposed on the warm-up circuit, the warm-up switch valve is configured to be freely switchable between the communicating position and the blocking position, the communicating position being for making the connection fluid tube be communicated, the blocking position being for making the connection fluid tube be blocked. Accordingly, in the hydraulic system, the provision of the warm-up switch valve enables the signal tube to be warmed up as needed.

Meanwhile, in the fifth aspect of the present invention, the warm-up switch valve is controlled to be switched to the communicating position when the temperature of the hydraulic operation fluid is equal to or less than the first temperature and to be switched to the blocking position when the temperature of the hydraulic operation fluid is equal to or more than the second temperature higher than a first temperature. In this manner, the control of the warm-up switch valve can prevent the temperature of the hydraulic operation fluid from excessively increasing.

Additionally, in the sixth aspect of the present invention, the warm-up switch valve is switched to the blocking position when the revolution speed of the engine is higher than the predetermined revolution speed. In this manner, the control of the warm-up valve can prevent the temperature of the hydraulic operation fluid from excessively increasing.

Moreover, in the seventh aspect of the present invention, the warm-up switch valve is switched to the communicating position when the lock lever is set to the second position, the lock lever is configured to be set from the first position (a non-lifted position) to the second position (a lifted position), the second position being for disabling operations of the hydraulic actuators. In this manner, the control of the warm-up valve can steadily avoid an operational error.

DESCRIPTION OF THE EMBODIMENTS

Referring to drawings, embodiments of the present invention will be described below.

Figure 1:
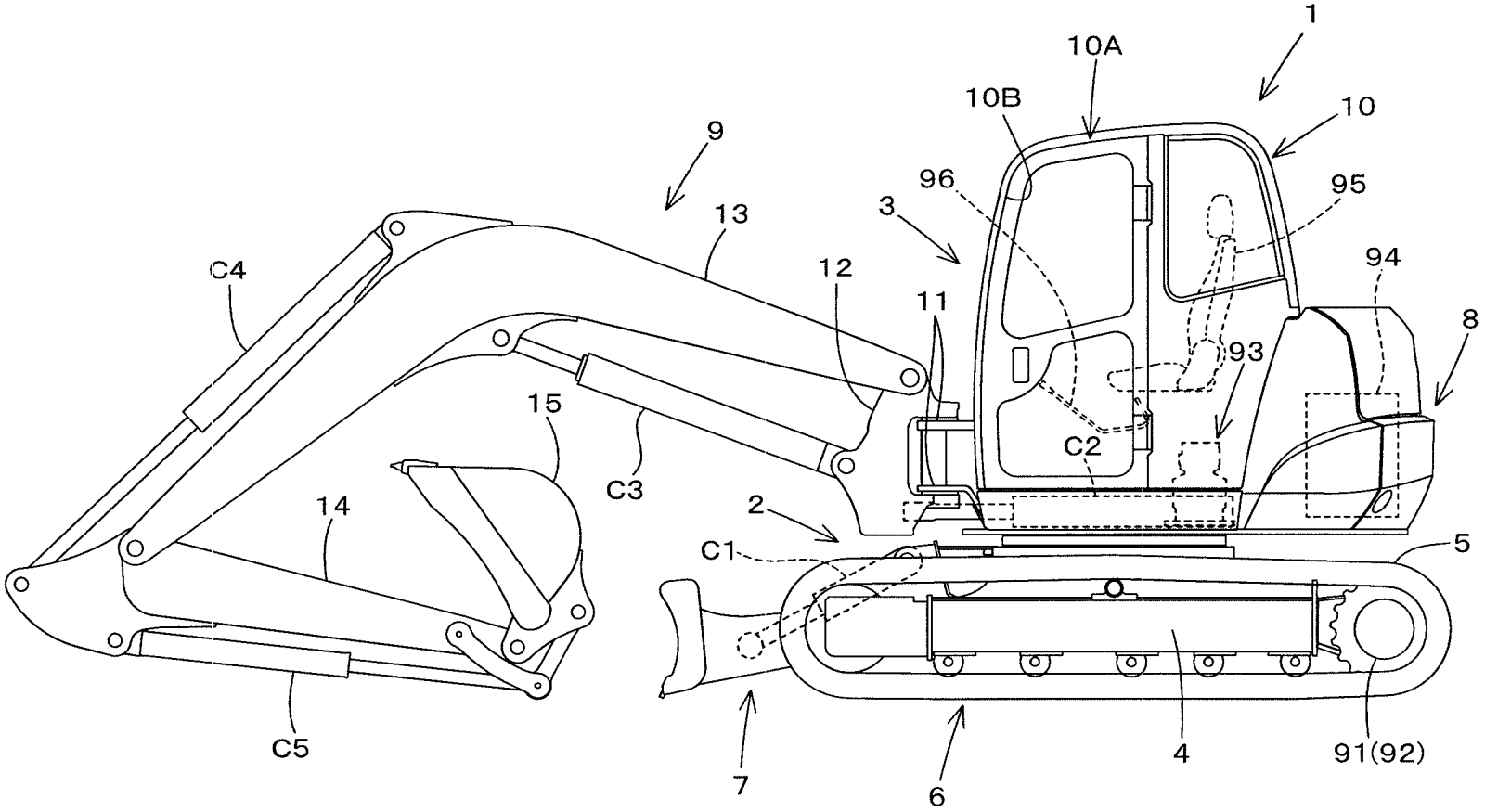
FIG. 1 is a view showing a side surface of a backhoe.

In FIG. 1, a reference numeral (a reference sign) "1" indicates a backhoe exemplified as a working machine.

The backhoe 1 includes a travel unit 2 and a turn unit 3. The travel unit 2 is disposed on a lower portion of the backhoe 1. The turn unit 3 is mounted on the travel unit 2 to be disposed on an upper portion of the backhoe 1, the turn unit 3 is capable of freely turning about a turn axis extending along a vertical direction.

The travel unit 2 is provided with two crawler type travel devices 6. One of the crawler type travel devices 6 is disposed on a right side of a truck frame 4 included in the backhoe 1. The other one of the crawler type travel devices 6 is disposed on a left side of the truck frame 4. The crawler type travel device 6 includes travel motors 91 and 92 and two crawler belts 5. The travel motors 91 and 92 are each constituted of hydraulic motors. The crawler belts 5 are circularly fed in a circumferential direction by the travel motors 91 and 92.

A dozer unit 7 is provided on a front portion of the truck frame 4. The dozer unit 7 has a blade, the blade is capable of being moved upward and downward by the stretching and shortening of a dozer cylinder C1, the dozer cylinder C1 is constituted of a hydraulic cylinder connected to the blade.

The turn unit 3 is provided with a turn base 8, a front working unit 9 (an excavation unit), and a cabin 10. The turn base 8 is a machine body mounted on the truck frame 4, the machine body is capable of freely turning about the turn axis. The front working unit 9 is provided on a front portion of the turn base 8. The cabin 10 is mounted on the turn base 8.

An engine 94, a radiator, a fuel tank, a hydraulic operation fluid tank 105, a battery, and the like are provided on the turn base 8. The backhoe 1 is provided with a turn motor 93 constituted of a hydraulic motor, and the turn motor 93 is capable of turning the turn base 8 about a vertical axis.

In addition, a support bracket 11 is provided to a front portion of the turn base 8, the support bracket 11 being provided projecting forward from the turn base 8. The support bracket 11 is provided with a swing bracket 12. The swing bracket 12 is capable of swinging around the vertical axis. The swing bracket 12 is capable of swinging rightward and leftward by the stretching and shortening of a swing cylinder C2, the swing cylinder C2 is constituted of a hydraulic cylinder connected to the swing bracket 12.

The front working unit 9 includes a boom 13, an arm 14, and a bucket 15. The boom 13 is pivotally supported by an upper portion of the swing bracket 12 at a side closer to a base portion of the boom 13, thereby being capable of freely turning about a lateral axis (that is a right to left axis or a left to right axis). In this manner, the boom 13 is capable of swinging upward and downward. The arm 14 is pivotally supported by the boom 13 at a side closer to a tip end portion of the boom 13. The arm 14 is capable of turning about the lateral axis at a base portion of the arm 14, thereby being capable of swinging forward and backward. The bucket 15 is pivotally supported by the arm 14 at a side closer to a tip end portion of the arm 14. The bucket 15 is capable of turning about the lateral axis, thereby being capable of swinging forward and backward.

A boom cylinder C3 is disposed between the boom 13 and the swing bracket 12, the boom cylinder C3 being constituted of a hydraulic cylinder. The stretching of the boom cylinder C3 moves the boom 13 upward. In addition, the shortening of the boom cylinder C3 moves the boom 13 downward.

An arm cylinder C4 is disposed between the arm 14 and the boom 13, the arm cylinder C4 being constituted of a hydraulic cylinder. The stretching of the arm cylinder C4 swings the arm 14 backward, thereby performing the crowding (a crowding movement). In addition, the shortening of the arm cylinder C4 swings the arm 14 forward, thereby performing the dumping (a dumping movement).

A bucket cylinder C5 is disposed between the bucket 15 and the arm 14, the bucket cylinder C5 being constituted of a hydraulic cylinder. The stretching of the bucket cylinder C5 swings the bucket 15 backward, thereby performing the crowding (a scooping movement). In addition, the shortening of the bucket cylinder C5 swings the bucket 15 forward, thereby performing the dumping (a dumping movement).

The boom cylinder C3, the arm cylinder C4, and the bucket cylinder C5 are each constituted of hydraulic cylinders.

An operator seat 95 is provided on a rear portion of an inside space of the cabin 10. The cabin 10 is provided with a boarding entrance 10B disposed on a front portion of a left side surface of the cabin 10, the boarding entrance 10B is capable of being opened and closed by a boarding door 10A. A lock lever 96 is provided on a left side of the operator seat 95, the lock lever 96 is disposed extending across the boarding entrance 10B. The lock lever 96 is capable of being pulled up (lifted up) from a non-lifted position (a first position) to a lifted position (a second position) higher than the non-lifted position.

In addition, when the operator pulls up (lifts up) the lock lever 96 (to the lifted position) before getting off the backhoe 1, an operator can move the lock lever 96 to a position where the lock lever 96 does not intervene the boarding and the getting-off. Moreover, the travel motors 91 and 92, the turn motor 93, the dozer cylinder C1, the swing cylinder C2, the boom cylinder C3, the arm cylinder C4, and the bucket cylinder C5, that is, the hydraulic actuators 91, 92, 93, and C1 to C5 provided on the backhoe 1 cannot be operated when the lock lever 96 is pulled up (lifted up).

Then, referring to FIG. 2 to FIG. 4, a hydraulic system according to one embodiment of the present invention will be described below, the hydraulic system being for operating the hydraulic actuators provided on the backhoe 1, that is, the travel motors 91 and 92, the turn motor 93, the dozer cylinder C1, the swing cylinder C2, the boom cylinder C3, the arm cylinder C4, and the bucket cylinder C5.

Figure 2:
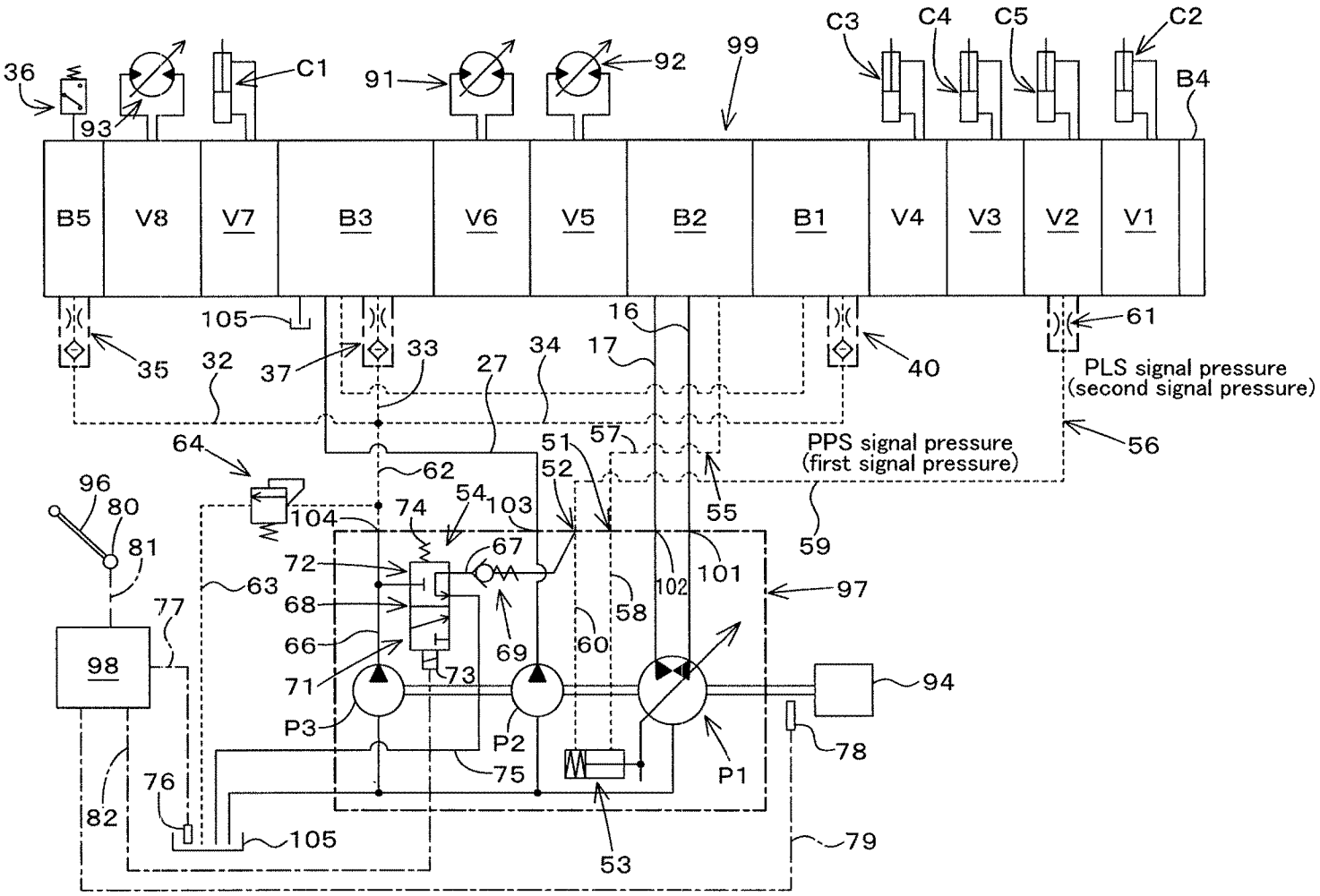
FIG. 2 is a view showing an overall structure of a hydraulic circuit according to one embodiment of the present invention.

As shown in FIG. 2, the hydraulic system includes a pressure fluid supply unit 97, a control unit 98, and a control valve 99.

The pressure fluid supply unit 97 includes a first pump P1, a second pump P2, a third pump P3, a first discharge port 101, a second discharge port 102, a third discharge port 103, a fourth discharge port 104, a PPS (Pressure of Pump Sensing) input port (a first input port) 51, a PLS (Pressure of Load sensing) input port (a second input port) 52, a regulator 53, and a warm-up circuit 54. The first discharge port 101, the second discharge port 102, the third discharge port 103, and the fourth discharge port 104 discharge pressured hydraulic fluids (the pressured hydraulic operation fluids).

The first pump P1, the second pump P2, and the third pump P3 are pumps driven by the engine 94. The first discharge port 101, the second discharge port 102, the third discharge port 103, and the fourth discharge port 104 output the pressured hydraulic fluids discharged by the first pump P1, the second pump P2, and the third pump P3.

In addition, the warm-up circuit 54 may be provided outside the pressure fluid supply unit 97.

The first pump P1 (hereinafter referred to as a main pump) is a variable displacement axial pump having a swash plate (a variable displacement pump), and is a uniform-flow double pump (a hydraulic pump of a split-flow type) for supplying approximately identical discharge flows respectively from independent two discharge ports.

Meanwhile, the main pump P1 may be constituted of two pumps that are configured separately from each other.

The first discharge port 101 outputs the pressured hydraulic fluid discharged from one of the discharge ports of the main pump P1. In addition, the second discharge port 102 outputs the pressured hydraulic fluid discharged from the other one of the discharge ports of the main pump P1. The hydraulic system according to the embodiment includes a first discharge tube 16 (also referred to as a first discharge path 16) and a second discharge tube 17 (also referred to as a second discharge path 17). The first discharge tube 16 is connected to the first discharge port 101. The second discharge tube 17 is connected to the second discharge port 102.

The pressured hydraulic fluids discharged from the main pump P1 are used in the travel motors 91 and 92, the boom cylinder C3 of the front working unit 9, the arm cylinder C4, the bucket cylinder C5, and the swing cylinder C2.

In the main pump P1, the swash plate is controlled by the regulator 53. In particular, the regulator 53 controls the swash plate of the main pump P1, thereby controlling a discharge pressure (a discharge amount) of the main pump P1.

The hydraulic system employs a load sensing system. The load sensing system controls a discharge amount of the main pump P1 on the basis of pressures under loads generated in the swing cylinder C2, the boom cylinder C3, the arm cylinder C4, and the bucket cylinder C5, thereby making the main pump P1 discharge the pressured hydraulic fluid (the hydraulic operation fluid) satisfying the pressures under loads. In this manner, the hydraulic circuit according to the embodiment can save a motive power of the main pump P1, and further the hydraulic circuit can improve operability, for example, an operational performance and an operational response.

In the load sensing system, the regulator 53 controls the swash plate of the main pump P1 to control the discharge pressure (the discharge amount) of the main pump P1. In this manner, the load sensing system maintains a differential pressure (between "a PPS signal pressure and a PLS signal pressure") to be a constant pressure (an LS control differential pressure), the differential pressure being obtained by subtracting the PLS signal pressure (a second signal pressure) from the PPS signal pressure (a first signal pressure) that is the discharge pressure of the main pump P1, the PLS signal pressure being the maximum one of the pressures under load generated in the swing cylinder C2, the bucket cylinder C5, the arm cylinder C4, and the boom cylinder C3.

The hydraulic system includes a PPS signal tube 55 (also referred to as a PPS signal path 55) and a PLS signal tube 56 (also referred to as a PLS signal path 56). The PPS signal tube 55 and the PLS signal tube 56 are connected to the regulator 53. The PPS signal tube 55 is a tube for sending the PPS signal pressure from the control valve 99 to the regulator 53. The PLS signal tube is a tube for sending the PLS signal pressure from the control valve 99 to the regulator 53.

The PPS signal tube 55 includes a first PPS fluid tube 57 and a second PPS fluid tube 58. The first PPS fluid tube 57 extends from the control valve 99 to the PPS input port 51. The second PPS fluid tube 58 extends from the PPS input port 51 to the regulator 53.

The PLS signal tube 56 includes a first PLS fluid tube 59 (also referred to as a first PLS fluid path 59) and a second PLS fluid tube 60 (also referred to as a second PLS fluid path 60). The first PLS fluid tube 59 extends from the control valve 99 to the PLS input port 52. The second PLS fluid tube 60 extends from the PLS input port 52 to the regulator 53. The hydraulic system includes a throttle (a throttle for PLS) 61 used for obtaining a stable operation. The throttle 61 is provided to an end portion of the first PLS fluid tube 59, the end portion being on a side closer to the control valve 9.

The first PPS fluid tube 57 and the first PLS fluid tube 59 are constituted mainly of hydraulic hoses.

The second pump P2 (hereinafter referred to as a sub pump) and the third pump P3 (hereinafter referred to as a pilot pump) are constituted of constant displacement gear pumps. The pressured hydraulic fluid discharged from the sub pump P2 is outputted from the third discharge port 103. The pressured hydraulic fluid discharged from the pilot pump P3 is outputted from the fourth discharge port 104.

The pressured hydraulic fluid discharged from the sub pump P2 is used mainly in the turn motor 93 and in the dozer cylinder C1. In addition, the pressured hydraulic fluid discharged from the sub pump P2 is used also in the boom cylinder C3, in the arm cylinder C4, in the bucket cylinder C5, and in the swing cylinder C2. The pressured hydraulic fluid discharged from the pilot pump P3 is used for supplying a pilot pressure and a signal pressure such as a detection signal.

As shown in FIG. 2, the hydraulic system according to the embodiment includes a third discharge tube 27 (also referred to as a third discharge path 27). The third discharge tube 27 is connected to the third discharge port 103. The hydraulic system according to the embodiment further includes a fourth discharge tube 62 (also referred to as a fourth discharge path 62). The fourth discharge tube 62 is connected to the fourth discharge port 104. The fourth discharge tube 62 branches into a valve operation detection tube 32 (also referred to as a valve operation detection line 32), a first pilot pressure supply tube 33 (also referred to as a first pilot pressure supply path 33), and a second pilot pressure supply tube 34 (also referred to as a second pilot pressure supply path 34). In addition, the hydraulic system includes a relief fluid tube 63 (also referred to as a relief fluid path 63) communicated with the hydraulic operation fluid tank 105. The relief fluid tube 63 is connected to the fourth discharge tube 62. The hydraulic system also includes a pilot relief valve 64, and the pilot relief valve 64 is provided on the middle of the relief fluid tube 63.

The hydraulic system according to the embodiment includes a main discharge tube 66 (also referred to as a main discharge path 66). The main discharge tube 66 connects the fourth discharge port 104 and the discharge port of the pilot pump P3 to each other. A discharge circuit for the pilot pump P3 is constituted of the main discharge tube 66, the valve operation detection tube 32, the first pilot pressure supply tube 33, and the second pilot pressure supply tube 34.

Figure 5:
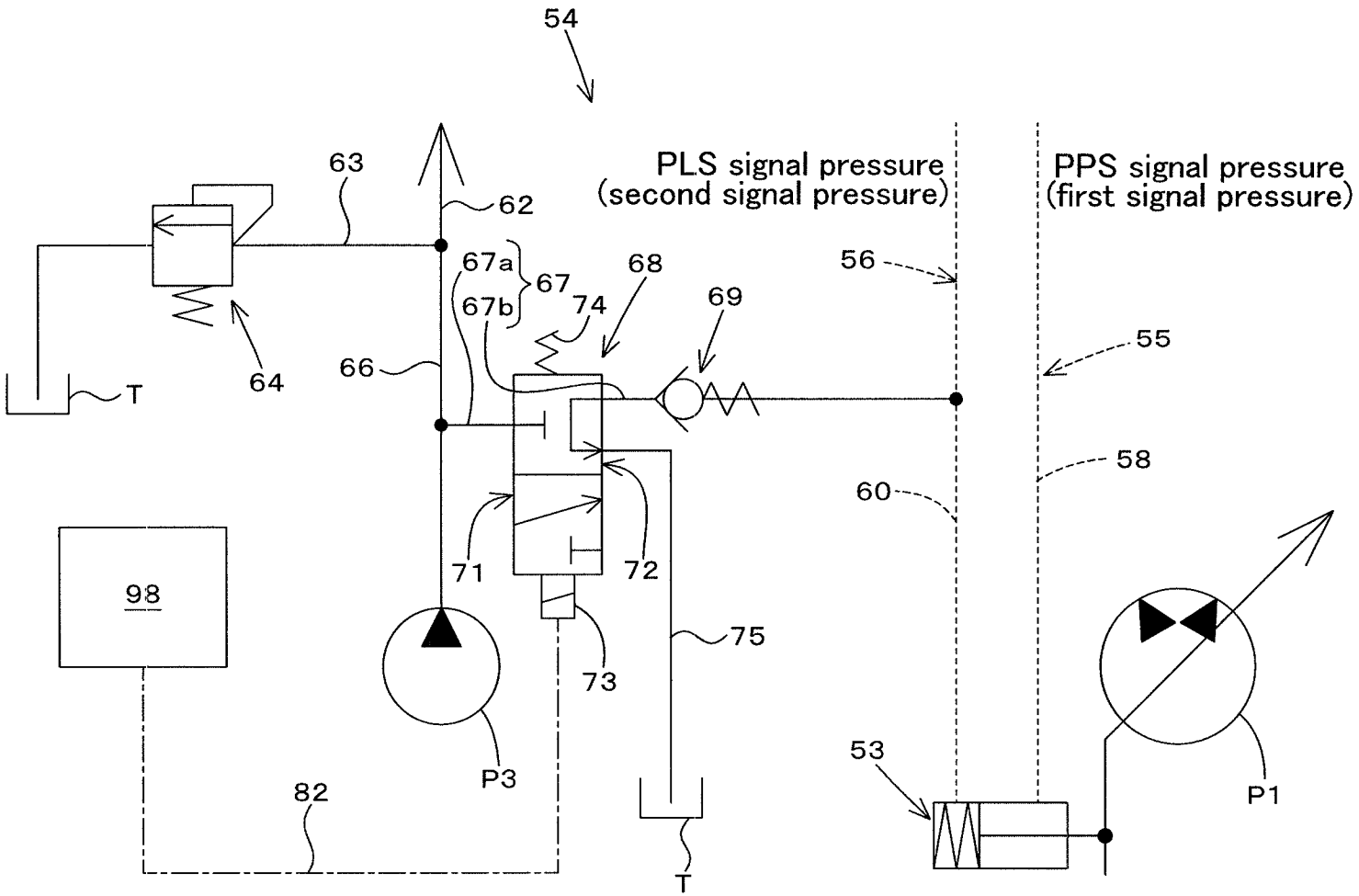
FIG. 5 is a view showing a main portion of the hydraulic circuit.

As shown in FIG. 5, the warm-up circuit 54 includes a connection fluid tube 67 (a connection fluid path 67), a warm-up switch valve 68, and a check valve 69.

The connection fluid tube 67 is a fluid tube (a fluid path) for connecting the PLS signal tube 56 and the discharge circuit for the pilot pump P3 to each other. The warm-up switch valve 68 and the check valve 69 are provided on the connection fluid tube 67.

The connection fluid tube 67 includes a first connection tube 67*a* (a first connection path 67*a*) and a second connection tube 67*b* (a second connection path 67*b*).

One end of the first connection tube 67*a* is connected to the main discharge tube 66, the main discharge tube 66 being included in the discharge circuit for the pilot pump P3. The other end of the first connection tube 67*a* is connected to the warm-up switch valve 68. One end of the second connection tube 67*b* is connected to the warm-up switch valve 68. The other end of the second connection tube 67*b* is connected to the PLS input port 52.

The warm-up switch valve 68 is constituted of a solenoid valve. The warm-up switch valve 68 is freely switchable between a communicating position 71 and a blocking position 72, the communicating position 71 being for making the connection fluid tube 67 be communicated, the blocking position 72 being for making the connection fluid tube 67 be blocked. In addition, the warm-up switch valve 68 is switched to the communicating position 71 by activating a solenoid 73 provided to the warm-up switch valve 68. Moreover, the warm-up switch valve 68 is switched to the blocking position 72 by a spring 74 after the solenoid 73 is deactivated.

Furthermore, the second connection tube 67*b* is connected to a drain tube 75 when the warm-up switch valve 68 is in the blocking position 72, the drain tube 75 being included in the hydraulic circuit. Meanwhile, the warm-up switch valve 68 according to the embodiment is constituted of an electromagnetic on-off valve, and however may be constituted of an electromagnetic proportional valve and of a pilot operation switch valve capable of being switched by a pilot pressure.

The check valve 69 is disposed on the middle of the second connection tube 67*b* of the connection fluid tube 67 (on a downstream side of the warm-up switch valve 68). In addition, the check valve 69 prevents the hydraulic operation fluid from flowing backward, the backward flow running from the PLS signal tube 56 toward a side of the discharge circuit for the pilot pump P3.

As shown in FIG. 2, the hydraulic circuit according to the embodiment includes a first signal tube 77 (a first signal path 77), a second signal tube 79 (a second signal path 79), a third signal tube 81 (a third signal path 81), and a fourth signal tube 82 (a forth signal path 82). The first signal tube 77, the second signal tube 79, the third signal tube 81, and the fourth signal tube 82 are connected to the control unit 98.

The first signal tube 77 is a tube (a fluid path) configured to transmit, to the control unit 98, a detection signal outputted from a fluid temperature detection sensor 76, the fluid temperature detection sensor 76 being a sensor for detecting a temperature of the hydraulic operation fluid.

The second signal tube 79 is a tube (a fluid path) configured to transmit, to the control unit 98, a detection signal outputted from an engine speed sensor 78, the engine speed sensor 78 being a sensor for detecting a revolution speed of the engine 94.

The third signal tube 81 is a tube (a fluid path) configured to transmit, to the control unit 98, a detection signal outputted from an operation sensor 80, the operation sensor 80 being a sensor for detecting that the lock lever 96 is pulled up (lifted up) to the lifted position.

The fourth signal tube 82 is a tube (a fluid path) configured to transmit, to the solenoid 73 of the warm-up switch valve 68, an activation signal and a deactivation signal each outputted from the control unit 98.

In the embodiment, the fluid temperature detection sensor 76 is a sensor for detecting a temperature of the hydraulic operation fluid stored in the hydraulic operation fluid tank 105. The control unit 98 outputs a command signal to the warm-up switch valve 68 when the temperature of the hydraulic operation fluid is equal to or less than a predetermined first temperature (for example, 20° C.), the command signal being for instructing the warm-up switch valve 68 to be switched to the communicating position 71. In addition, the control unit 98 outputs a command signal to the warm-up switch valve 68 when the temperature of the hydraulic operation fluid is equal to or more than a predetermined second temperature (for example, 30° C.) higher than the first temperature, the command signal being for instructing the warm-up switch valve 68 to be switched to the blocking position 72.

Moreover, the control unit 98 outputs a command signal to the warm-up switch valve 68 when the revolution speed of the engine 94 is equal to or more than a predetermined revolution speed, the command signal being for instructing the warm-up switch valve 68 to be switched to the blocking position 72.

Furthermore, the control unit 98 outputs a command signal to the warm-up switch valve 68 when the lock lever 96 is pulled up (lifted up) to the lifted position, the command signal being for instructing the warm-up switch valve 68 to be switched to the communicating position 71.

As shown in FIG. 2, the control valve 99 arranges: control valves V1 to V8 respectively for controlling the hydraulic actuators 91, 92, 93, and C1 to C5; a first intermediate block B1; a second intermediate block B2; a third intermediate block B3; a first terminal block B4; and a terminal block B5 in one direction to integrate the components.

The control valve V1 is a swing control valve configured to control movement of the swing cylinder C2. The control valve V2 is a bucket control valve configured to control movement of the bucket cylinder C5. The control valve V3 is an arm control valve configured to control movement of the arm cylinder C4. The control valve V4 is a boom control valve configured to control movement of the boom cylinder C3. The control valve V5 is a right travel control valve configured to control movement of the right travel motor 92. The control valve V6 is a left travel control valve configured to control movement of the left travel motor 91. The control valve V7 is a dozer control valve configured to control movement of the dozer cylinder C1. The control valve V8 is a turn control valve configured to control movement of the turn motor 93.

The control valves V1 to V8 are arranged along a direction from the right side toward the left side in FIG. 2 in accordance with the above mentioned order of appearance in the above description.

Figure 3:
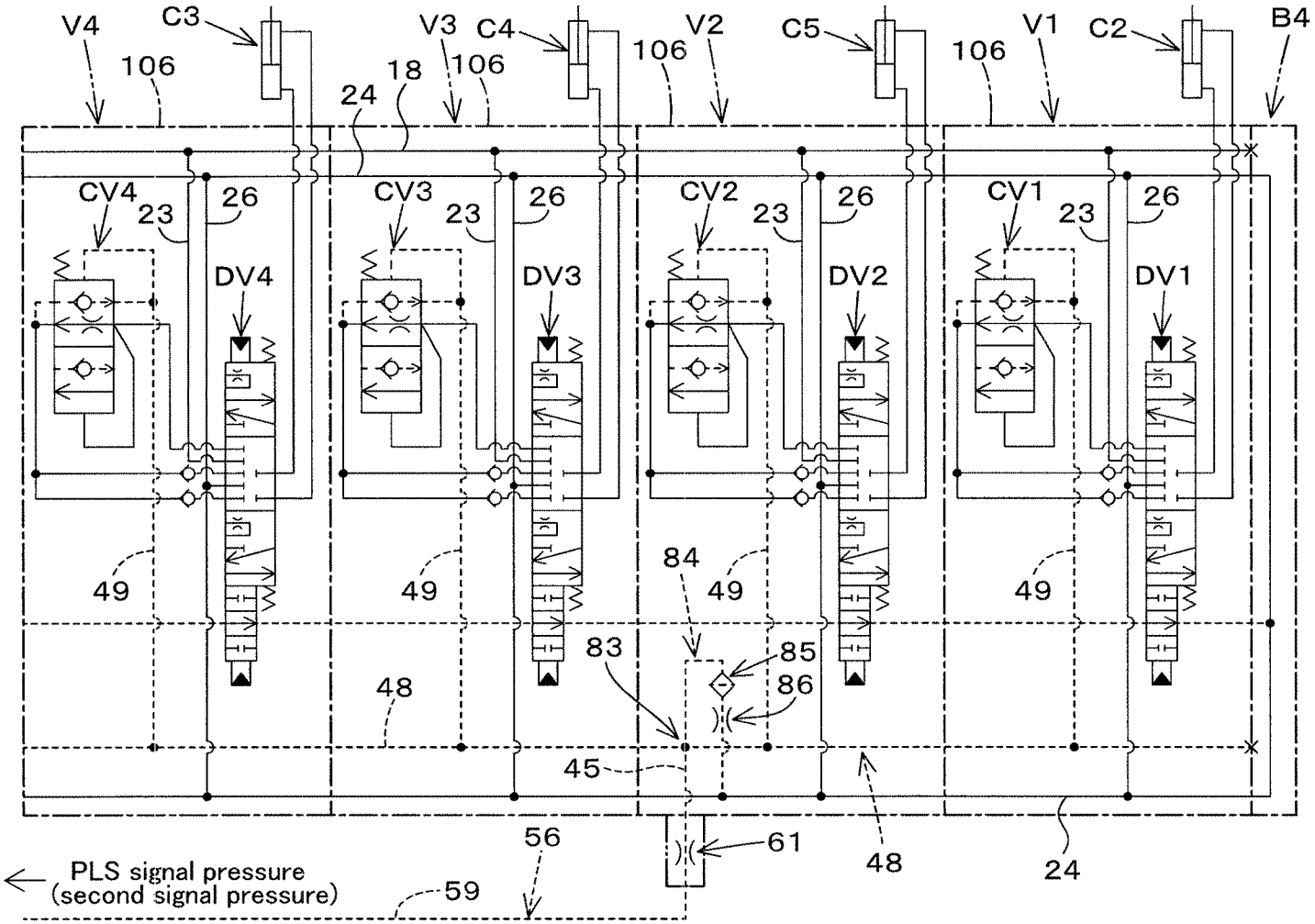
FIG. 3 is a view showing a hydraulic circuit of a left half of a control valve illustrated in FIG. 2.
Figure 4:
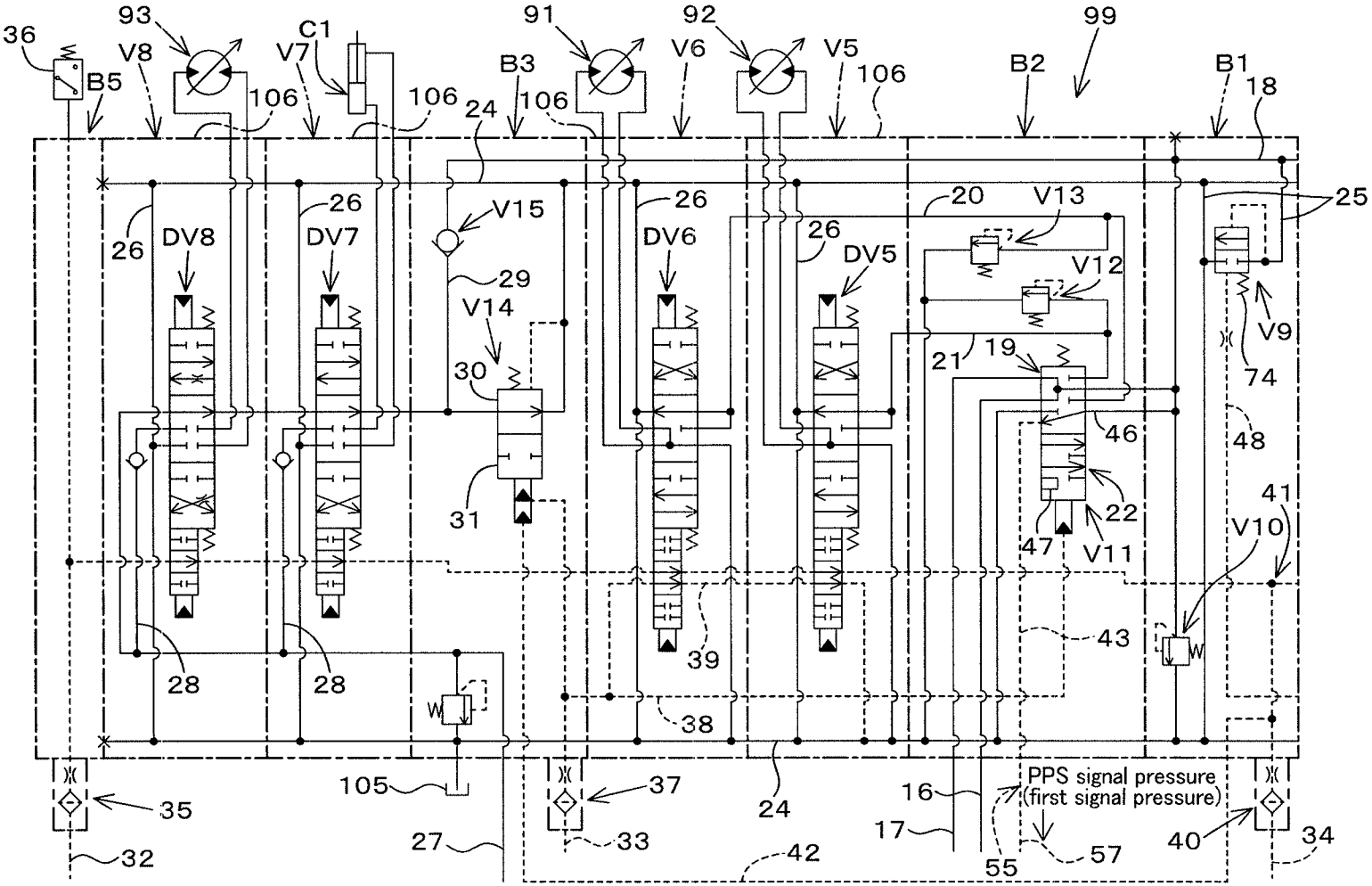
FIG. 4 is a view showing a hydraulic circuit of a right half of the control valve illustrated in FIG. 2.

As shown in FIG. 3 and FIG. 4, each of the control valves V1 to V8 is constituted of a valve body 106. The valve bodies 106 of the control valves V1 to V8 respectively include direction switch valves DV1 to DV8 internally. In this manner, the control valve V1, for example, is constituted of the valve body 106 internally including the direction switch valve DV1, the direction switch valve DV1 being configured to switch flow of the pressured hydraulic fluids. The control valve V2, for example, is constituted of the valve body 106 internally including the direction switch valve DV2, the direction switch valve DV2 being configured to switch flow of the pressured hydraulic fluids. The control valve V3, for example, is constituted of the valve body 106 internally including the direction switch valve DV3, the direction switch valve DV3 being configured to switch flow of the pressured hydraulic fluids. In addition, the swing control valve V1, the bucket control valve V2, the arm control valve V3, and the boom control valve V4 respectively include pressure compensation valves (compensator valves) CV1 to CV4 internally in the corresponding valve bodies 106. For example, the valve body 106 of the swing control valve V1 internally includes the pressure compensation valve CV1. When two or more cylinders of the boom cylinder C3, the arm cylinder C4, the bucket cylinder C5, and the swing cylinder C2 move, the pressure compensation valves CV1 to CV4 serve as adjusters for loads between the moving cylinders.

Each of the direction switch valves DV1 to DV8 is constituted of a switch valve having a directly-actuated spool. In addition, each of the direction switch valves DV1 to DV8 is constituted of a pilot-operated switch valve configured to be operated by the pilot pressure.

Meanwhile, the spools of the direction switch valves DV1 to DV8 are respectively moved in proportion to operation amounts (operation extents) of corresponding operation tools, the operation tolls being respectively configured to operate the direction switch valves DV1 to DV8. The direction switch valves DV1 to DV8 respectively supply the pressured hydraulic fluids to the hydraulic actuators 91, 92, 93, and C1 to C5 which are controlled objects, supply amounts of the pressured hydraulic fluids are proportional to amounts of movement of the spools each included in the direction switch valves DV1 to DV8. In addition, operation speeds of the operated objects (the above-mentioned controlled objects) can be changed in proportion to the operation amounts of the operation tools.

Meanwhile, in the embodiment, the lifted position of the lock lever 96 prevents a remote control valves from generating a secondary pressure, the remote control valve being configured to control the direction switch valves DV1 to DV8 by using the pilot pressure. In this manner, operations of the hydraulic actuators 91, 92, 93, and C1 to C5 can be prevented.

As shown in FIG. 4, an unload valve V9 and a main relief valve V10 are disposed on the first intermediate block B1. The unload valve V9 is a valve having a spool pushed by the spring 74 to a direction to close the valve. The main relief valve V10 is a relief valve for the main pump P1.

A first flow path switch valve V11 and relief valves V12 and V13 are disposed on the second intermediate block B2. The first flow path switch valve V11 is constituted of a pilot-operated switch valve having a directly-actuated spool. The relief valves V12 and V13 are provided as relief valves for the travel control valves V5 and V6.

A second flow path switch valve V14 is disposed on the third intermediate block B3. The second flow path switch valve V14 is constituted of a pilot-operated switch valve having a directly-actuated spool.

The first intermediate block B1 is installed to be disposed between the boom control valve V4 and the second intermediate block B2. The second intermediate block B2 is installed to be disposed between the right travel control valve V5 and the first intermediate block B1. The third intermediate block B3 is installed to be disposed between the left travel control valve V6 and the dozer control valve V7.

As shown in FIG. 3, the first terminal block B4 is connected to the swing control valve V1. In addition, the second terminal block B5 is connected to the turn control valve V8.

As shown in FIG. 2, FIG. 3 and FIG. 4, the first discharge port 101 is indirectly connected to the first flow path switch valve V11 by the first discharge tube 16. The second discharge port 102 is indirectly connected to the first flow path switch valve V11 by the second discharge tube 17.

The first flow path switch valve V1 is freely switchable between a confluent position 19 and an independently-supplying position 22. At the confluent position 19, the first flow path switch valve V1 connects the first discharge tube 16 and the second discharge tube 17 to a supply line (a supply tube) 18, the supply line 18 being configured to supply the pressured hydraulic fluids to the boom control valve V4, the arm control valve V3, the bucket control valve V2, and the swing control valve V1. In addition, at the independently-supplying position 22, the first flow path switch valve V1 connects the first discharge tube 16 to a travel left supply tube (a travel left supply path) 20, and connects the second discharge tube 17 to a travel right supply tube (a travel right supply path) 21, the travel left supply tube 20 being a tube for supplying the pressured hydraulic fluid to the left travel control valve V6, and the travel right supply tube 21 being a tube for supplying the pressured hydraulic fluid to the right travel control valve V5. The first flow path switch valve V11 is switched to the confluent position 19 by the spring 74 and is switched to the independently-supplying position 22 by the pilot pressure.

The supply tube 18 (also referred to as a front operation supply line 18) extends to be disposed from the first intermediate block B1 to the valve bodies 106 of the boom control valve V4, the arm control valve V3, the bucket control valve V2, and the swing control valve V1. The front operation supply line 18 is connected to the main relief valve V10 at one end of the supply line 18, the other end of the supply line 18 is closed.

In addition, the front operation supply line 18 is connected to the direction switch valves DV1 to DV4 of the swing control valve V1, the bucket control valve V2, the arm control valve V3, and the boom control valve V4 by a hydraulic operation fluid supply tube 23 (also referred to as a hydraulic operation fluid supply path 23).

Meanwhile, the control valve 99 is provided with a drain tube 24 (also referred to as a drain line 24) extending from the first terminal block B4 to the turn control valve V8.

The front operation supply line 18 is connected to the drain tube 24 through a connection fluid tube 25 (also referred to as a connection fluid path 25) and the unload valve V9. In addition, the direction switch valves DV1 to DV8 respectively included in the control valves V1 to V8 are connected to the drain tube 24 through a drain fluid tube 26 (also referred to as a drain fluid path 26).

The third discharge tube 27 is connected to the second flow path switch valve V14, the third discharge tube 27 passing serially through the direction switch valve DV8 of the control valve V8 and the direction switch valve DV7 of the control valve V7. A supply tube 28 (also referred to as a supply path 28) is included in the control valve 99 and used for supplying the pressured hydraulic fluid to the turn control valve V8 and the dozer control valve V7. The supply tube 28 is connected to the third discharge tube 27.

One end of a connection fluid tube 29 (also referred to as a connection fluid path 29) is connected to an upstream side of the second flow path switch valve V14 included in the third discharge tube 27, the upstream side is a lower stream side of the dozer control valve V7. The other one end of the connection fluid tube 29 is connected to the front operation supply line 18. Moreover, a check valve V15 is included in midstream of the connection fluid tube 29, the check valve V15 is used for blocking a backward flow of the pressured hydraulic fluid supplied from a side connected to the front operation supply line 18.

The second flow path switch valve V14 is freely switchable between a non-supply position 30 and a supply position 31. The second flow path switch valve V14 connects the third discharge tube 27 to the drain tube 24 at the non-supply position 30, thereby not supplying the pressured hydraulic fluid to the front operation supply line 18, the pressured hydraulic fluid being supplied from the sub pump P2. The second flow path switch valve V14 blocks the communication between the third discharge tube 27 and the drain tube 24 at the supply position 31, thereby supplying the pressured hydraulic fluid to the front operation supply line 18 through the connection fluid tube 29, the pressured hydraulic fluid being supplied from the sub pump P2. The second flow path switch valve V14 is switched to the non-supply position 30 by a spring 74, and is switched to the supply position 31 by the pilot pressure.

The valve operation detection tube 32 is connected to the drain tube 24 serially through a first signal pressure introduction part 35 provided on the second terminal block B5, the direction switch valve DV8 included in the turn control valve V8, the direction switch valve DV7 included in the dozer control valve V7, the direction switch valve DV6 included in the left travel control valve V6, the direction switch valve DV5 included in the right travel control valve V5, the direction switch valve DV4 included in the boom control valve V4, the direction switch valve DV3 included in the arm control valve V3, the direction switch valve DV2 included in the bucket control valve V2, and the direction switch valve DV I included in the swing control valve V1.

In FIG. 4, an AI (Alarm Interface) switch 36 is constituted of a pressure switch. The AI switch 36 is connected to an intermediate portion of the valve operation detection tube 32 between the first signal pressure introduction part 35 and the turn control valve V8. Actuation of any one of the control valves V1 to V8 from a neutral position, the actuation blocks a part of the valve operation detection tube 32, thereby generating a hydraulic pressure in the valve operation detection tube 32. The AI switch 36 detects the generated pressure.

A speed of the engine 94 is automatically controlled. Under the automatic control, the speed of the engine 94 automatically decreases to an idling speed when the AI switch 36 detects no pressure. Meanwhile, the speed of the engine 94 automatically increases to a predetermined speed when the AI switch 36 detects a hydraulic pressure.

The first pilot pressure supply tube 33 is introduced from a second signal pressure introduction part 37 into the third intermediate block B3. The introduced first pilot pressure supply tube 33 is connected to a pilot reception part of the second flow path switch valve V14 in the third intermediate block B3, the pilot reception part being a part (a receptor) for receiving a pilot pressure. The first pilot pressure supply tube 33 is connected to one end of a first flow path switch tube 38 (also referred to as a first flow path switch path 38) in the third intermediate block B3. The other end of the first flow path switch tube 38 is connected to a pilot reception part of the first flow path switch valve V11 in the second intermediate block B2, the pilot reception part being a part (a receptor) for receiving a pilot pressure.

A travel detection tube 39 (also referred to as a travel detection line 39) is included in the control valve 99. One end of the travel detection tube 39 is connected to the first flow path switch tube 38 in the left travel control valve V6. The other end of the travel detection tube 39 is connected to the drain tube 24 in the right travel control valve V5 sequentially through the direction switch valve DV6 and the direction switch valve DV5, the direction switch valve DV6 being included in the left travel control valve V6, the direction switch valve DV5 being included in the right travel control valve V5.

The second pilot pressure supply tube 34 is introduced from a third signal pressure introduction part 40 into the first intermediate block B1. In addition, the second pilot pressure supply tube 34 is connected to a connecting portion 41 of the valve operation detection tube 32 in the first intermediate block B1. The connecting portion 41 is on a downstream side of the right travel control valve V5 and is on an upstream side of the boom control valve V4.

A second flow path switch tube 42 (also referred to as a second flow path switch path 42) is included in the control valve 99. One end of the second flow path switch tube 42 is connected to an intermediate portion of the second pilot pressure supply tube 34 between the connecting portion 41 and the third signal pressure introduction part 40. The other end of the second flow path switch tube 42 is connected to a pilot reception part of the second flow path switch valve V14 in the third intermediate block B3, the pilot reception part being a part (a receptor) for receiving a pilot pressure.

In the hydraulic system according to the embodiment, without operations of both of the right travel control valve V5 and the left travel control valve V6, the first flow path switch valve V11 is set to the confluent position 19 and the second flow path switch valve V14 is set to the non-supply position 30. The hydraulic fluids discharged from the first discharge tube 16 of and the second discharge tube 17 of the main pump P1 are merged in one flow, thereby supplying the pressured hydraulic fluid to the direction switch valves DV1 to DV4 respectively included in the swing control valve V1, the bucket control valve V2, the arm control valve V3, and the boom control valve V4. Meanwhile, the pressured hydraulic fluid from the sub pump P2 is drained after sequentially passing through the turn control valve V8 and the dozer control valve V7.

After the above-described state of both of the right travel control valve V5 and the left travel control valve V6, a part of the travel detection tube 39 is blocked when the right travel control valve V5 and the left travel control valve V6 are operated. The blocking of the travel detection tube 39 generates hydraulic pressures in both of the travel detection tube 39 and the first flow path switch tube 38. In this manner, the pressure generated in the first flow path switch tube 38 switches the first flow path switch valve V11 to the independently-supplying position 22.

Accordingly, the hydraulic fluid discharged from the first discharge port 101 is supplied to the left travel control valve V6 via the first discharge tube 16, and the hydraulic fluid discharged from the first discharge port 102 is supplied to the right travel control valve V5 via the second discharge tube 17. Meanwhile, the hydraulic fluids discharged from the first discharge port 101 and from the second discharge port 102 are not supplied to the swing control valve V1, the bucket control valve V2, the arm control valve V3, and the boom control valve V4.

Further after this state, when at least one of the swing control valve V 1, the bucket control valve V2, the arm control valve V3, and the boom control valve V4 is operated, the second flow path switch valve V14 is switched to the supply position 31 by a hydraulic pressure summed up of the hydraulic pressure in the first pilot pressure supply tube 33 and the hydraulic pressure in the second flow path switch tube 42. Thereby, the sub pump P2 can supply the pressured hydraulic fluid to the boom control valve V4, the arm control valve V3, the bucket control valve V2, and the swing control valve V1.

The load sensing system according to the embodiment works to control a discharge pressure (a discharge amount) of the main pump P1 against load pressures of the boom cylinder C3, the arm cylinder C4, the bucket cylinder C5, and the swing cylinder C2 under a state where the first flow path switch valve V11 is set to the confluent position 19. In addition, the load sensing system according to the embodiment employs a load sensing system of a so-called after-orifice type, the load sensing system having the pressure compensation valves CV1 to CV4 respectively connected behind (on a downstream side of) the direction switch valves DV1 to DV4, the direction switch valves DV1 to DV4 being respectively included in the swing control valve V1, the bucket control valve V2, the arm control valve V3, and the boom control valve V4.

The load sensing system is provided with a PPS transmission tube 43 (also referred to as a PPS transmission line 43) and a PLS transmission tube 44 (also referred to as a PLS transmission line 44) in the control valve 99. The PPS transmission tube 43 serves as a hydraulic fluid tube (a hydraulic fluid path) for transmitting the discharge pressure (the PPS signal pressure) of the main pump P1 to the regulator 53 through the PPS signal tube 55. The PLS transmission tube 44 serves as a hydraulic fluid tube (a hydraulic fluid path) for transmitting the highest load pressure (the PLS signal pressure) of the load pressures in the swing cylinder C2, the bucket cylinder C5, the arm cylinder C4, and the boom cylinder C3 to the regulator 53 through the PLS signal tube 56.

As shown in FIG. 4, the PPS transmission tube 43 is connected to the first flow path switch valve V11 at one end of the PPS transmission tube 43 and connected to the PPS signal tube 55 at the other end. In addition, the PPS transmission tube 43 is connected to the front operation supply line 18 through a connection fluid tube 46 (a connection fluid path 46) under a state where the first flow path switch valve V11 is switched to the confluent position 19. In this manner, the PPS transmission tube 43 transmits the PPS signal pressure from the PPS signal tube 55 to the regulator 53.

Meanwhile, the PPS transmission tube 43 is communicated to the drain tube 24 through a relief fluid tube 47 (also referred to as a relief fluid line 47) when the first flow path switch valve V11 is switched to the independently-supplying position 22. Then, the PPS signal pressure decreases to be zero (0). In that case, the swash plate of the main pump P1 is controlled to have the maximum angle, and thereby the main pump P1 discharge the maximum flow amount (the maximum discharge amount).

As shown in FIG. 3 and FIG. 4, the PLS transmission tube 44 is constituted of a load pressure detection tube 48 (also referred to as a load pressure detection line 48), a load pressure transmission tube 49 (also referred to as a load pressure transmission line 49), and a connection tube 45 (also referred to as a connection line 45).

The load pressure detection tube 48 is disposed in the control valve 99, extending from the first intermediate block B1 serially to the valve body 106 of the boom control valve V4, the valve body 106 of the arm control valve V3, the valve body 106 of the bucket control valve V2, and the valve body 106 of the swing control valve V1. In addition, the load pressure detection tube 48 is connected to a pilot reception part provided on a side of the spring 74 at one end of the load pressure detection tube 48, the spring 74 being configured to push a spool of the unload valve V9 toward a direction to close the unload valve V9. The load pressure detection tube 48 is closed at the other end.

The load pressure detection tube 48 is connected to each of the pressure compensation valves CV1 to CV4 through the load pressure transmission tubes 49, the pressure compensation valves CV1 to CV4 being respectively included in the swing control valve V1, the bucket control valve V2, the arm control valve V3, and boom control valve 4.

The load pressure detection tube 48 is connected to the PLS signal tube 56 by the connection tube 45.

In addition, the load pressure detection tube 48 is connected to the drain tube 24 by a drain fluid tube 84 (also referred to as a drain fluid line 84), the drain fluid tube 84 is connected to a connecting portion 83 of the connection tube 45. The drain fluid tube 84 is provided with a filter 85 and a throttle (a throttle for discard) 86.

In the load sensing system, the loads applied to the swing cylinder C2, the boom cylinder C3, the arm cylinder C4, and the bucket cylinder C5 are transmitted to the load pressure detection tube 48 through each of the load pressure transmission tubes 49. The maximum load pressure of the load pressures applied to the swing cylinder C2, the boom cylinder C3, the arm cylinder C4, and the bucket cylinder C5 is transmitted as the PLS signal pressure to the regulator 53 from the load pressure detection tube 48 through the connection tube 45 and the PLS signal tube 56.

Referring to the drawings, the load sensing system according to the embodiment will be described below.

The discharge pressure of the main pump P1 increases when the first flow path switch valve V11 is set to the confluent position 19 and the direction switch valves DV1 to DV4 of the swing control valve V1, the bucket control valve V2, the arm control valve V3, and the boom control valve V4 are set to the neutral position, thereby increasing a difference between the PPS signal pressure and the PLS signal pressure (the PLS signal pressure being zero at that moment) to be more than the LS control differential pressure. After that, the main pump P1 is controlled to reduce the discharge amount under a flow control and the unload valve V9 opens, thereby dropping the hydraulic fluid discharged from the main pump P1 (the hydraulic operation fluid in the front operation supply line 18) into the hydraulic operation fluid tank 105. Accordingly, the discharge pressure of the main pump P1 decreases, under that state, to a pressure set by the unload valve V9, and thereby the main pump P1 discharges the hydraulic operation fluid at the minimum discharge amount.

Considering a case where the first flow path switch valve V11 is set to the confluent position 19 and at least one of the boom control valve V4, the swing control valve V1, the bucket control valve V2, and the arm control valve V3 is operated, the load sensing system according to the embodiment works as described below.

In that case, the maximum load pressure of the load pressures applied to the hydraulic cylinders C2 to C5 serves as the PLS signal pressure. Then, the discharge pressure of the main pump P1 is automatically controlled to set the difference between the PPS signal pressure and the PLS signal pressure to be equal to the LS control differential pressure. In association with that, the flow amount discharged from the main pump P1 begins to increase after an unload flow amount passing through the unload valve V9 decreases to zero, and then all the amount of the hydraulic fluid discharged from the main pump P1 flow into the presently operated hydraulic cylinders C2 to C5 in accordance with operation amounts of the presently operated control valves V1 to V4.

In addition, the pressure compensation valves CV1 to CV4 compensate differential pressures to be constant between a pressure in a front of and a pressure in a back of the spools of the direction switch valves DV1 to DV4 included in the presently operated control valves V1 to V4. In this manner, regardless of differences between magnitudes of the loads applied to the presently operated hydraulic cylinders C2 to C5, the flow amount discharged from the main pump P1 is branched into some partial flow amounts corresponding to the operation amounts of the presently operated hydraulic cylinders C2 to C5, thereby supplying the some partial flow amounts of the flow amount discharged from the main pump P1 to the presently operated hydraulic cylinders C2 to C5.

Additionally, considering a case where the first flow path switch valve V11 is set to the confluent position 19 and one of the boom control valve V4, the swing control valve V1, the bucket control valve V2, and the arm control valve V3 is solely operated, the main pump P1 discharges the hydraulic operation fluid of an amount corresponding to the operation amounts of the presently operated control valves V1 to V4. The hydraulic operation fluid discharged from the main pump P1 is supplied to the presently operated hydraulic cylinders C2 to C5.

Meanwhile, considering a case where a sum of the demanded flow amounts in each of the presently operated hydraulic cylinders C2 to C5 exceeds the maximum flow amount discharged from the main pump P1, the maximum flow amount discharged from the main pump P1 is proportionally distributed to the presently operated hydraulic cylinders C2 to C5.

In the hydraulic system according to the embodiment, the control unit 98 outputs an excitation signal to switch the warm-up switch valve 68 to the communicating position 71 in the warming-up of the hydraulic system by starting the engine 94 when the lock lever 96 is pulled up to the lifted position and a temperature of the hydraulic operation fluid is equal to or less than a first temperature. Then, the hydraulic pilot fluid discharged from the pilot pump P3 flows to the PLS signal tube 56.

The hydraulic pilot fluid flowing in the PLS signal tube 56, the hydraulic pilot fluid being discharged from the pilot pump P3, circulates from the PPS input port 51 serially to the first PLS fluid tube 59 of the PLS signal tube 56, the throttle 61 for PLS, the connection tube 45, the drain fluid tube 84, the drain tube 24, the hydraulic operation fluid tank 105, and the pilot pump P3. After that, the PLS signal tube 56 and the throttle 61 for PLS are warmed up. In this manner, the hydraulic system according to the embodiment is capable of eliminating the response lag of the load sensing system in the low temperature (the hydraulic system according to the embodiment is capable of improving the response of the load sensing system in the low temperature).

In addition, the pilot pressure transmitted to the PLS signal tube 56, the pilot pressure discharged from the pilot pump P3, is transmitted to the regulator 53. When the pilot pressure is transmitted to the regulator 53, the PLS signal pressure transmitted to the regulator 53 serves as the pilot pressure. Then, the regulator 53 controls the main pump P1 to set the PPS signal pressure (the discharge pressure of the main pump P1) to be a sum of "the pilot pressure and the LS control differential pressure", thereby increasing the flow amount discharged from the main pump P1. In this manner, the temperature of the hydraulic operation fluid rapidly increases to shorten a time for the warming-up.

In the embodiment, the pilot relief valve 64 keeps the pilot pressure discharged from the pilot pump P3 to an approximately constant pressure of 4 MPa, the pilot pressure being stable at a low pressure. In addition, a preset pressure of the unload valve V9 is set to 2.2 MPa, and the LS control differential pressure is set to 1.4 MPa. Accordingly, the sum of "the pilot pressure and the LS control differential pressure" is 5.4 MPa when the pilot fluid from the pilot pump P3 flows in the PLS signal tube 56, thereby exceeding the preset pressure of the unload valve V9.

Meanwhile, a pressure is generated in the PLS signal tube 56 when the pilot pressure from the pilot pump P3 is transmitted to the PLS signal tube 56; however, a pressure in the load pressure detection line 48 is kept at a drain pressure due to the throttle 61 for PLS. Thus, a pressure on a PLS side of the unload valve V9 is at the drain pressure. In other words, the unload valve V9 controls the PPS signal pressure to be the preset pressure of the unload valve V9 in a usual manner.

As the result, the flow amount discharged from the main pump P1 increases, and the discharge pressure of the main pump P1 is controlled, due to an override characteristic of the unload valve V9, to set the PPS signal pressure to be equal to the sum of "the pilot pressure and the LS control differential pressure". In this manner, the control to the main pump P1 can be stable.

Meanwhile, the control unit 98 outputs a demagnetization signal to switch the warm-up switch valve 68 to the blocking position 72 when the hydraulic operation fluid is warmed to be at a temperature equal to or higher than a second temperature. In this manner, the control unit 98 stops the supply of the hydraulic pilot fluid to the PLS signal tube 56. In addition, when the revolution speed of the engine 94 is high, the control unit 98 also switches the warm-up switch valve 68 to the blocking position 72 in the above-mentioned manner. Moreover, when the lock lever 96 is pulled down to the non-lifted position, the control unit 98 also switches the warm-up switch valve 68 to the blocking position 72 in the above-mentioned manner.

The pilot pressure is discharged from the pilot pump P3 at a constant low pressure. In the above-described manner, the transmission of the pilot pressure to the PLS signal tube 56 balances the swash plate of the main pump P1 at a certain plate angle between the minimum plate angle and the maximum plate angle. In this manner, the hydraulic system according to the embodiment can prevent a speed of the warming-up from excessively increasing, thereby being able to prevent the temperature of the hydraulic operation fluid from excessively increasing and further being able to maintain an effect of the warming-up stably for a long time.

In the embodiment, when the warming-up starts at −20° C. in an outdoor temperature, the hydraulic system according to the embodiment begins to provide the effect of the warming-up after 15 minutes passed, and sufficiently provides the effect after 30 minutes have passed. After that, the hydraulic system according to the embodiment is capable of stably maintaining the effect of the warming-up. The effect of the warming-up can be maintained after one hour passed, the maintain of the effect having been confirmed by the inventors of the present invention. That is, the effect of the warming-up is stable in the PLS signal tube 56 and in the throttle 61 for PLS since the warm-up switch valve 68 stays at the communicating position 71 after the one-hour warming-up. Accordingly, compared to conventional techniques, the hydraulic system according to the embodiment does not request the operator to frequently repeat the switching of the switch valve in pauses of the working, and thereby the operator can use the working machine without feeling uncomfortable.

In addition, the check valve 69 is capable of preventing a high-pressured pilot fluid from flowing in a backward direction from the PLS signal tube 56 to a side of the discharge circuit for the pilot pump P3.

Moreover, the provision of the warm-up switch valve 68 enables the PLS signal tube 56 to be warmed up as needed.

Furthermore, the control described below to the warm-up switch valve 68 is capable of preventing the hydraulic operation fluid from being excessively warmed; the control switches the warm-up switch valve 68 to the communicating position 71 when the temperature of the hydraulic operation fluid is equal to or less than the predetermined first temperature and switches the warm-up switch valve 68 to the blocking position 72 when the temperature of the hydraulic operation fluid is equal to or more than the second temperature higher than the first temperature.

In addition, since the control unit 98 switches the warm-up switch valve 68 to the blocking position 72 when the revolution speed of the engine 94 is high, the hydraulic operation fluid can be prevented from being excessively warmed.

Moreover, since the control unit 98 switches the warm-up switch valve 68 to the communicating position 71 when the lock lever 96 is pulled up to the lifted position, an operational error can be steadily avoided.

Meanwhile, the control to the warm-up switch valve 68 may be performed at least on the basis of a detection signal from the fluid temperature detection sensor 76. In addition, it is preferable to perform: the control based on the engine speed sensor 78; and the control based on the lock lever 96, however, the controls are not essential in the hydraulic system according to the embodiment.

Moreover, the warm-up switch valve 68 may be configured to be controlled only based on the fluid temperature detection sensor 76 and the engine speed sensor 78. Furthermore, the warm-up switch valve 68 may be configured to be controlled only based on the fluid temperature detection sensor 76 and the lock lever 96.

Figure 6A:
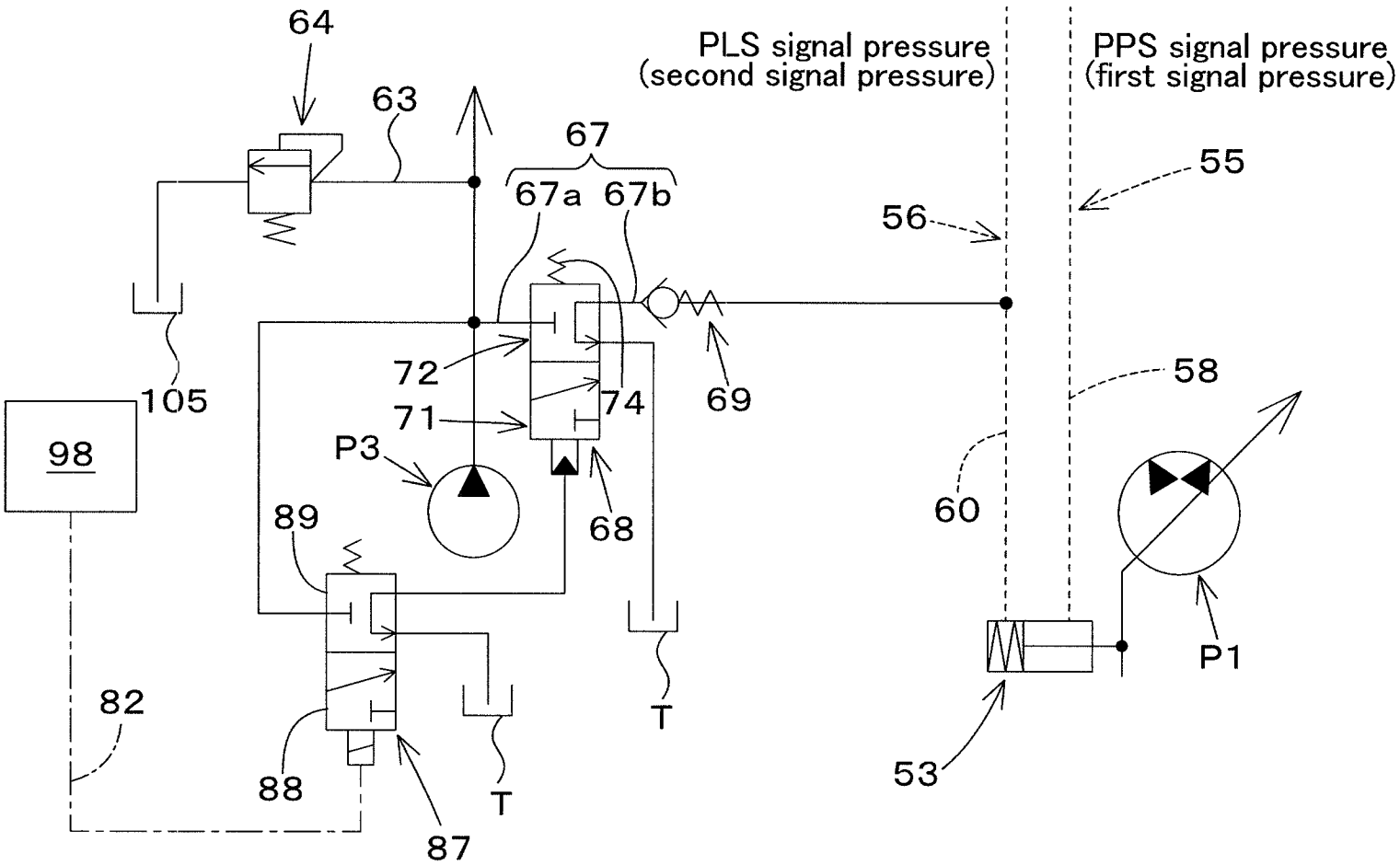
FIG. 6A is a view showing a hydraulic circuit according to the other embodiment of the present invention.
Figure 6B:
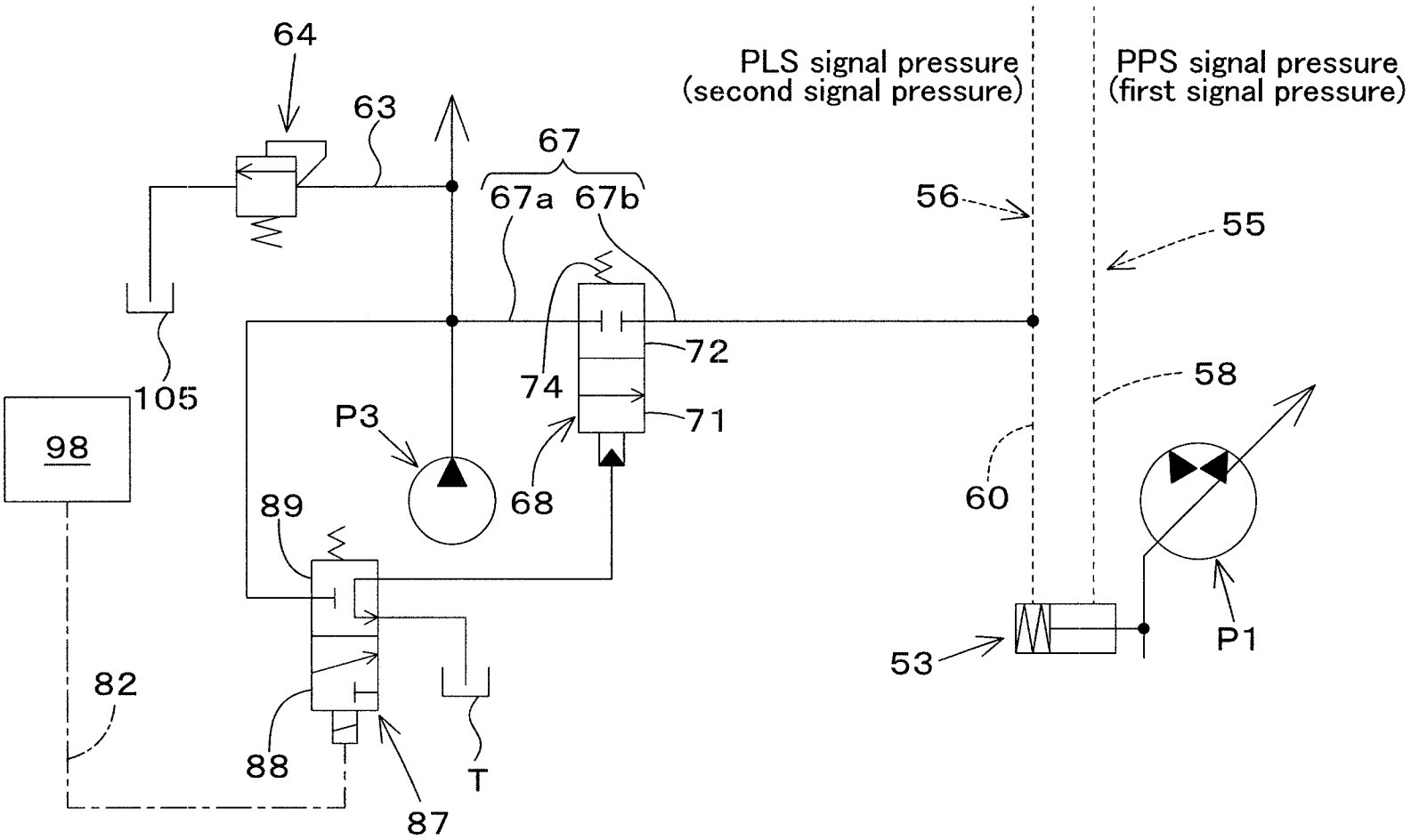
FIG. 6B is a view showing a hydraulic circuit according to the other embodiment.

FIG. 6A and FIG. 6B show a warm-up circuit 54 according to the other embodiment.

In the warm-up circuit 54 shown in FIG. 6A, the warm-up switch valve 68 is constituted of a pilot-operated switch valve having a directly-actuated spool operated by the pilot pressure. The warm-up circuit 54 according to the other embodiment is different in including a pilot valve 87 constituted of an electromagnetic valve for operating the warm-up switch valve 68 with use of the hydraulic pilot fluid. Other configurations according to the embodiment are the same as those according to the above-mentioned one embodiment shown in FIG. 1 to FIG. 5.

The pilot valve 87 is freely switchable between an actuating position 88 and an actuation releasing position 89. The pilot valve 87 switches the warm-up switch valve 68 to the communicating position 71 at the actuating position 88. The pilot valve 87 switches the warm-up switch valve 68 to the blocking position 72 at the actuation releasing position 89. The pilot valve 87 is switched to the actuating position 88 due to an excitation signal outputted from the control unit 98, and is switched to the actuation releasing position 89 due to a demagnetization signal outputted from the control unit 98.

The warm-up circuit 54 shown in FIG. 6B is also constituted of a pilot-operated switch valve having a directly-actuated spool operated by the pilot pressure. The warm-up circuit 54 includes a pilot valve 87 constituted of an electromagnetic valve for operating the warm-up switch valve 68 with use of the hydraulic pilot fluid.

The warm-up switch valve 68 according to the embodiment does not connect the second connection tube 67*b* to the drain tube 75 at the blocking position 72, the warm-up switch valve 68 closes an end portion of the second connection tube 67*b,* the end portion being connected to the warm-up switch valve 68. In addition, the embodiment does not employ the check valve 69.

Other configurations according to the embodiment are the same as those according to the above-mentioned one embodiment.

Meanwhile, in the embodiment shown in FIG. 6B, it is preferable to control the warm-up switch valve 68 to be switched to the blocking position 72 necessarily when the lock lever 96 is pulled down to the non-lifted position. The warm-up switch valve 68 is controlled in that manner in order to steadily prevent the hydraulic fluid from flowing from the PLS signal tube 56 toward a side of the discharge circuit for the pilot pump P3, that is, to prevent the backward flow of the hydraulic fluid (the hydraulic pressure).

What is claimed is:

1. A hydraulic system for a working machine, comprising:
- a plurality of hydraulic actuators;
- a control valve configured to control the hydraulic actuators;
- a tank configured to store a hydraulic operation fluid;
- a variable displacement pump configured to discharge the hydraulic operation fluid stored in the tank to supply the hydraulic operation fluid to the hydraulic actuators;
- a regulator configured to control the variable displacement pump;
- a pilot pump configured to discharge a hydraulic pilot fluid;
- a load sensing system configured to control a discharge pressure of the variable displacement pump with use of the regulator to maintain a differential pressure to be a constant pressure, the differential pressure being obtained by subtracting a second signal pressure from a first signal pressure that is the discharge pressure of the variable displacement pump, the second signal pressure being the maximum one of the load pressures generated in the hydraulic actuators;
- a signal tube provided extending from the control valve to the regulator, the signal tube being configured to send the second signal pressure to the regulator;
- a throttle provided on the signal tube; and
- a warm-up circuit configured to supply the hydraulic pilot fluid to a downstream side of the throttle provided on the signal tube.

2. The hydraulic system for a working machine according to claim 1, further comprising:
- a discharge circuit configured to make the hydraulic operation fluid flow, wherein
- the warm-up circuit includes:
  - a connection fluid tube configured to connect the discharge circuit and the signal tube to each other; and
  - a check valve configured to prevent a backward flow from the signal tube toward a side of the discharge circuit.

3. The hydraulic system for a working machine according to claim 2, wherein
- the warm-up circuit includes:
  - a warm-up switch valve configured to be freely switchable between a communicating position and a blocking position, the communicating position being for making the connection fluid tube be communicated, the blocking position being for making the connection fluid tube be blocked.

4. The hydraulic system for a working machine according to claim 3, further comprising:
- a control unit configured to control the warm-up switch valve; and
- a fluid temperature detection sensor configured to detect a temperature of the hydraulic operation fluid, wherein
- the control unit switches the warm-up switch valve to the communicating position when the fluid temperature detection sensor detects a temperature equal to or less than a first temperature and switches the warm-up switch valve to the blocking position when the fluid temperature detection sensor detects a temperature equal to or more than a second temperature higher than a first temperature.

5. The hydraulic system for a working machine according to claim 3, further comprising:
- a control unit configured to control the warm-up switch valve;
- an engine; and
- an engine speed sensor configured to detect a revolution speed of the engine, wherein
- the control unit switches the warm-up switch valve to the blocking position when the engine speed sensor detects a revolution speed equal to or higher than a predetermined revolution speed.

6. The hydraulic system for a working machine according to claim 3, further comprising:
- a control unit configured to control the warm-up switch valve; and
- a lock lever configured to be set from a first position to a second position, the second position being for disabling operations of the hydraulic actuators, wherein
- the control unit switches the warm-up switch valve to the communicating position when the lock lever is set to the second position.

7. The hydraulic system for a working machine according to claim 1, further comprising:
- a discharge circuit configured to make the hydraulic operation fluid flow, wherein
- the warm-up circuit includes:
  - a connection fluid tube configured to connect the discharge circuit and the signal tube to each other; and
  - a warm-up switch valve configured to be freely switchable between a communicating position and a blocking position, the communicating position being for making the connection fluid tube be communicated, the blocking position being for making the connection fluid tube be blocked.

8. The hydraulic system for a working machine according to claim 7, further comprising:

a control unit configured to control the warm-up switch valve; and a fluid temperature detection sensor configured to detect a temperature of the hydraulic operation fluid, wherein the control unit switches the warm-up switch valve to the communicating position when the fluid temperature detection sensor detects a temperature equal to or less than a first temperature and switches the warm-up switch valve to the blocking position when the fluid temperature detection sensor detects a temperature equal to or more than a second temperature higher than a first temperature.

9. The hydraulic system for a working machine according to claim 7, further comprising:

a control unit configured to control the warm-up switch valve;

an engine; and an engine speed sensor configured to detect a revolution speed of the engine, wherein the control unit switches the warm-up switch valve to the blocking position when the engine speed sensor detects a revolution speed equal to or higher than a predetermined revolution speed.

10. The hydraulic system for a working machine according to claim 7, further comprising:

a control unit configured to control the warm-up switch valve; and a lock lever configured to be set from a first position to a second position, the second position being for disabling operations of the hydraulic actuators, wherein the control unit switches the warm-up switch valve to the communicating position when the lock lever is set to the second position.

* * * * *